US010499727B2

(12) United States Patent
Simpson

(10) Patent No.: US 10,499,727 B2
(45) Date of Patent: Dec. 10, 2019

(54) ADJUSTABLE CUTTING BRUSH

(71) Applicant: Marrico Simpson, Suffolk, VA (US)

(72) Inventor: Marrico Simpson, Suffolk, VA (US)

( * ) Notice: Subject to any disclaimer, the term of this patent is extended or adjusted under 35 U.S.C. 154(b) by 0 days.

(21) Appl. No.: 15/822,234

(22) Filed: Nov. 27, 2017

(65) Prior Publication Data

US 2019/0159584 A1 May 30, 2019

(51) Int. Cl.

| | |
|---|---|
| ***A46B 15/00*** | (2006.01) |
| ***A45D 24/36*** | (2006.01) |
| ***A46B 7/04*** | (2006.01) |
| ***B26B 19/20*** | (2006.01) |
| ***B26B 19/38*** | (2006.01) |

(52) U.S. Cl.

CPC ..... *A46B 15/0065* (2013.01); *A45D 24/36* (2013.01); *A46B 7/044* (2013.01); *B26B 19/20* (2013.01); *B26B 19/3813* (2013.01); *B26B 19/3846* (2013.01); *B26B 19/3873* (2013.01)

(58) Field of Classification Search

CPC .... A46B 15/0065; A46B 7/044; A45D 24/36; B26B 19/3846; B26B 19/3813; B26B 19/3873; B26B 19/20

See application file for complete search history.

(56) References Cited

U.S. PATENT DOCUMENTS 1,453,014 A * 4/1923 Kohn ..... A46B 15/0055 132/290
2,249,293 A * 7/1941 King ..... B26B 19/42 30/133
2,938,268 A * 5/1960 Drese ..... B26B 19/38 30/210
3,183,591 A * 5/1965 Dumont ..... B26B 19/42 15/23
4,888,870 A * 12/1989 Fujikawa ..... B26B 19/42 30/233.5
5,519,939 A * 5/1996 Smith ..... B26B 21/12 30/123
5,884,402 A * 3/1999 Talavera ..... B26B 19/00 30/124
6,406,157 B1 * 6/2002 Audet ..... A45D 24/36 132/289
6,698,048 B1 * 3/2004 Greene ..... B08B 9/021 29/90.01
7,007,388 B2 * 3/2006 Wan ..... B26B 19/16 30/123
7,581,319 B1 * 9/2009 Little ..... B26B 19/06 30/210
9,289,906 B2 * 3/2016 Croft ..... B26B 15/00
2003/0056374 A1 * 3/2003 Langley ..... B26B 19/20 30/200
2003/0204956 A1 * 11/2003 Chan ..... B26B 19/20 30/233.5
2004/0250429 A1 * 12/2004 McCambridge ..... B26B 19/20 30/233.5
2009/0165303 A1 * 7/2009 Burgess ..... B26B 19/063 30/29.5

(Continued)

*Primary Examiner* — Hwei-Siu C Payer

(74) *Attorney, Agent, or Firm* — The Iwashko Law Firm, PLLC; Lev Ivan Gabriel Iwashko

(57) ABSTRACT

An adjustable cutting brush, including a brush body, a handle removably attached to the brush body, a blade disposed on a surface of the brush body, and removable bristles attached to the surface of the brush body.

5 Claims, 1 Drawing Sheet

(56) References Cited

U.S. PATENT DOCUMENTS

| | | | | |
|---|---|---|---|---|
| 2009/0241975 | A1* | 10/2009 | Nakakura | A45D 24/10<br>132/120 |
| 2014/0053407 | A1* | 2/2014 | Michaely | B26B 19/16<br>30/49 |
| 2019/0159584 | A1* | 5/2019 | Simpson | A46B 15/0065 |

* cited by examiner

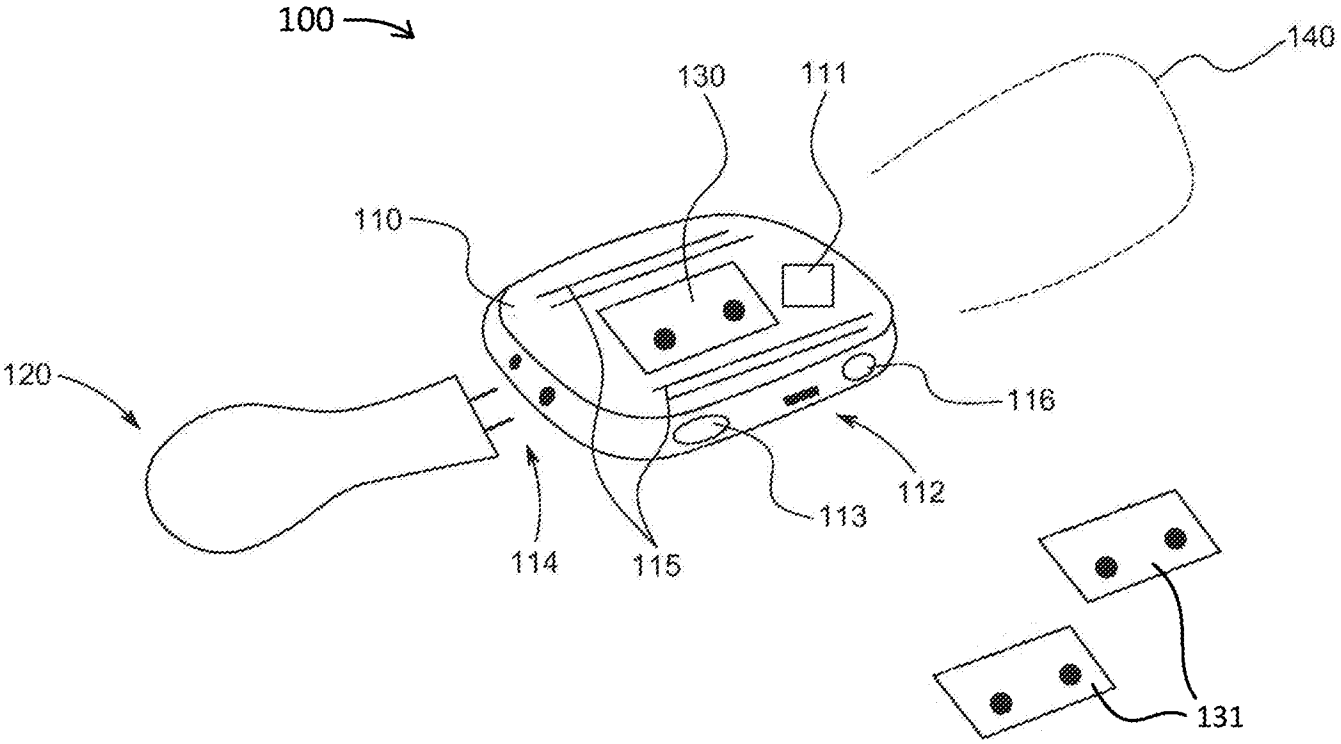
100
110
111
112
113
114
115
116
120
130
131
140

ADJUSTABLE CUTTING BRUSH

BACKGROUND OF THE INVENTION

1. Field of the Invention

The present general inventive concept relates generally to an adjustable cutting brush.

2. Description of the Related Art

When dealing with personal grooming, many people avoid the daunting task of self-hair-maintenance, preferring to go to a salon. Those who desire an at-home method of hair styling often know how to properly hold a hairbrush, but are unaware of the correct way to manage scissors and razors, making self-grooming a risky effort.

Therefore, there is a need for a brush designed like a hand held hair brush with attached hair cutting clippers, to enable users to accurately hold a clipping device, giving them the ability to trim their own hair.

SUMMARY

The present general inventive concept provides an adjustable cutting brush.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an adjustable cutting brush, including a brush body, a handle removably attached to the brush body, a blade disposed on a surface of the brush body, and removable bristles attached to the surface of the brush body.

The brush body may include at least one bristle groove to slidably receive the removable bristles.

The brush body may include a motor to move the blade, a battery to provide power to the motor, and a charging port to charge the battery.

The brush body may include at least one handle hole to receive the handle at a first side of the brush body.

The removable bristles may at least partially surround the blade.

BRIEF DESCRIPTION OF THE DRAWINGS

These and/or other features and utilities of the present general inventive concept will become apparent and more readily appreciated from the following description of the embodiments, taken in conjunction with the accompanying drawings of which:

FIG. 1 illustrates an adjustable cutting brush, according to an exemplary embodiment of the present general inventive concept.

DETAILED DESCRIPTION OF THE INVENTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

FIG. 1 illustrates an adjustable cutting brush 100, according to an exemplary embodiment of the present general inventive concept.

Referring to FIG. 1, the adjustable cutting brush 100 may include a brush body 110, a handle 120, a blade 130, and removable bristles 140.

The brush body 110 may include a motor 111, a charging port 112, a battery 113, at least one handle hole 114, bristle grooves 115, and a power button 116.

The motor 111 may be included to move the blade 130 in a manner similar to electric clippers that cut hair.

The charging port 112 may be included to allow the battery 113 to be recharged to provide power to the motor 111. The charging port can be any type of charging port, including, but not limited to, any type of universal serial bus charging port, or any other type of charging port known to one of ordinary skill in the art.

The at least one handle hole 114 may be included on multiple side portions of the brush body 110, in order to allow the handle 120 to be installed on various sides of the brush body, based on a user's preference. In some embodiments of the present general inventive concept, the at least one handle hole 114 may also serve as the charging port 112 when the handle 120 is detached therefrom.

The blade 130 may allow blade attachments 131 to be attached thereto, in order to clip hair of different lengths.

The bristle grooves 115 may be included to allow the removable bristles 140 to slide onto the brush body 110 via the bristle grooves 115, thereby being attached to a surface or face of brush body 110. As such, the user may interchange the removable bristles 140 with other bristles having different lengths, or in response to the removable bristles 140 needing to be cleaned or changed due to normal wear and tear. Therefore, the removable bristles 140 may at least partially surround the blade 130.

The power button 116 may be included on the body to provide power to allow the battery 113 to selectively provide power to the motor 111. In other words, the power button 116 may turn on the motor 111 such that the blade may move to cut the user's hair.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An adjustable cutting brush, comprising:

a brush body having a rectangular shape with rounded corners, the brush body comprising:

a plurality of handle holes disposed on multiple sides of the brush body, and a rectangular surface disposed on a center of the brush body;

a blade disposed on the rectangular surface to clip hair of different lengths;

a handle removably connected to at least one of the plurality of handle holes on the brush body; and removable bristles connected to a surface of the brush body on a first side of the rectangular surface and on a second side of the rectangular surface, such that the first side and the second side are opposite to each other with the blade disposed therebetween.

2. An adjustable cutting brush, comprising:

a brush body having a first planar surface and a second planar surface, the brush body comprising:

at least one bristle groove;

a handle removably attached to the brush body;

a blade disposed on the first planar surface of the brush body to clip hair of different lengths; and removable bristles attached to the first planar surface of the brush body such that the at least one bristle groove slidably receives the removable bristles.

3. The adjustable cutting brush of claim 1, wherein the brush body comprises:

a motor to move the blade;

a battery to provide power to the motor; and a charging port to charge the battery.

4. The adjustable cutting brush of claim 1, wherein the brush body comprises:

at least one handle hole to receive the handle at a first side of the brush body.

5. The adjustable cutting brush of claim 1, wherein the at least one bristle groove comprises two bristle grooves for slidably receiving the removable bristles which at least partially surround the blade.

* * * * *